US010014639B1

(12) United States Patent
Satyanarayanan et al.

(10) Patent No.: US 10,014,639 B1
(45) Date of Patent: Jul. 3, 2018

(54) ELECTRICAL RECEPTACLE

(71) Applicant: EATON CORPORATION, Cleveland, OH (US)

(72) Inventors: Karthik Satyanarayanan, Tamilnadu (IN); Nilesh Ankush Kadam, Maharashtara (IN)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 15/441,389

(22) Filed: Feb. 24, 2017

(51) Int. Cl.
*H01R 24/00* (2011.01)
*H01R 25/00* (2006.01)
*H01R 13/713* (2006.01)
*H01R 107/00* (2006.01)

(52) U.S. Cl.
CPC ..... *H01R 25/006* (2013.01); *H01R 13/7137* (2013.01); *H01R 2107/00* (2013.01)

(58) Field of Classification Search
CPC ..... H01R 24/006
USPC ..... 439/218, 107, 222
See application file for complete search history.

(56) References Cited

U.S. PATENT DOCUMENTS 3,343,117 A * 9/1967 Carlson ..... H01R 27/00 439/107
3,441,896 A * 4/1969 Hawkins ..... H01R 27/00 439/107
3,975,075 A * 8/1976 Mason ..... H01R 13/56 439/107
4,545,631 A * 10/1985 Zampini ..... H01R 27/02 439/107
4,583,799 A * 4/1986 Wiley ..... H01R 25/006 439/106
5,007,848 A * 4/1991 Lee ..... H01R 27/02 439/101
5,224,009 A * 6/1993 Misencik ..... H01R 13/6666 361/111
6,010,347 A * 1/2000 Lee ..... H01R 4/36 439/107
6,328,584 B1 * 12/2001 Follett ..... H01R 27/00 439/222
D505,856 S * 6/2005 Kim ..... D8/353
6,923,663 B2 * 8/2005 Oddsen ..... H01R 25/006 439/107
7,435,091 B1 * 10/2008 Cruz ..... H01R 31/06 439/18
7,547,221 B2 * 6/2009 Kim ..... H01R 13/70 439/211

(Continued)

*Primary Examiner* — Neil Abrams
(74) *Attorney, Agent, or Firm* — Eckert Seamans

(57) ABSTRACT

An electrical receptacle provides a plurality of outlets that are in different orientations. The electrical receptacle has a housing having a plurality of openings formed therein which are also referred to as contact openings, with each outlet having three contact openings. Each such outlet has a contact opening that is common with another outlet, meaning that a contact opening of one outlet and a contact opening of another outlet are actually an individual contact opening that is common to the two outlets and is thus shared therebetween. The electrical receptacle additionally includes a thermally protected metal oxide varistor (TMOV) that employs a thermal fuse and a metal oxide varistor (MOV) in order to protect electrical devices that are connected with the electrical receptacle from damage due to extended surges and spikes.

20 Claims, 6 Drawing Sheets

(56) References Cited

U.S. PATENT DOCUMENTS

| | | | | |
|---|---|---|---|---|
| 7,789,686 | B2 * | 9/2010 | Kim | H01R 29/00 439/218 |
| 8,348,682 | B1 * | 1/2013 | Draggie | H01R 25/006 439/107 |
| 8,439,692 | B1 * | 5/2013 | Oddsen | H01R 25/006 439/107 |
| 8,471,718 | B1 * | 6/2013 | Miller | G04C 23/04 307/131 |

* cited by examiner

ELECTRICAL RECEPTACLE

BACKGROUND

Field

The disclosed and claimed concept relates generally to electrical devices and, more particularly, to an electrical receptacle.

Related Art

Numerous types of electrical receptacles are known in the relevant art. A typical electrical receptacle is one that is connected with line, neutral, and ground conductors and that is cooperable with an electrical connector of an electrically-operated device in order to provide electrical power to the device. One such type of electrical receptacle is a polarized duplex receptacle. While such electrical receptacles have been generally effective for their intended purposes, they have not been without limitation.

A conventional polarized duplex receptacle is typically capable of receiving an electrical connector in electric communication therewith in only a single orientation. This can cause difficulty when it is desired to connect electrical devices situated at different locations with the electrical receptacle because straining of the electrical cable that extends from the electrical connector can result. Difficulty is encountered if electrical devices are desired to be connected with the electrical receptacle from different directions, such as if the electrical receptacle is mounted to the upper surface of a conference table, and the like. While attempts have been made to provide electrical receptacles having a plurality of outlets in a plurality of different orientations, such electrical receptacles have had limited success due to their cost and size. Additionally, it is known that electrical surges or spikes can destroy sensitive electronics within an electrical device, which is preferably avoided. Improvements thus would be desirable.

SUMMARY

An improved electrical receptacle meets these and other shortcomings in the relevant art by providing a plurality of outlets that are in different orientations. The electrical receptacle has a housing having a plurality of openings formed therein which are also referred to as contact openings, with each outlet having three contact openings. Each such outlet has a contact opening that is common with another outlet, meaning that a contact opening of one outlet and a contact opening of another outlet are actually an individual contact opening that is common to the two outlets and is thus shared therebetween. The electrical receptacle additionally includes a thermally protected metal oxide varistor (TMOV) that employs a thermal fuse and a metal oxide varistor (MOV) in order to protect electrical devices that are connected with the electrical receptacle from damage due to extended surges and spikes.

Accordingly, an aspect of the disclosed and claimed concept is to provide an improved electrical receptacle having a plurality of outlets that include a number of individual contact openings that are common between two or more outlets. As employed herein the expression "a number of" and variations thereof shall refer broadly to any non-zero quantity, including a quantity of one.

Another aspect of the disclosed and claimed concept is to provide an electrical receptacle that provides thermal metal oxide varistor (TMOV) protection to resist damage from extended surges or spikes.

Accordingly, an aspect of the disclosed and claimed concept is to provide an improved electrical receptacle structured to be electrically connected with a line conductor, a neutral conductor, and a ground conductor, the electrical receptacle further being structured to have a number of electrical connectors be placed in electrical connection therewith. The electrical receptacle can be generally stated as including a housing, an electrical apparatus that can be generally stated as including a line conduction element, a neutral conduction element, and a ground conduction element, the line conduction element being situated on the housing and structured to be electrically connected with the line conductor, the neutral conduction element being situated on the housing and structured to be electrically connected with the neutral conductor, the ground conduction element being situated on the housing and structured to be electrically connected with the ground conductor, a plurality of outlets that can be generally stated as including a first outlet and a second outlet, the first outlet can be generally stated as including a plurality of first openings formed in the housing, the plurality of first openings can be generally stated as including a first line contact opening that is in communication with the line conduction element, a first neutral contact opening that is in communication with the neutral conduction element, and a first ground contact opening that is in communication with the ground conduction element, the second outlet can be generally stated as including a plurality of second openings formed in the housing, the plurality of second openings can be generally stated as including a second line contact opening that is in communication with the line conduction element, a second neutral contact opening that is in communication with the neutral conduction element, and a second ground contact opening that is in communication with the ground conduction element, one of: i) the first line contact opening and the second line contact opening being an individual contact opening that is common between the first outlet and the second outlet, ii) the first neutral contact opening and the second neutral contact opening being an individual contact opening that is common between the first outlet and the second outlet, and iii) the first ground contact opening and the second ground contact opening being an individual contact opening that is common between the first outlet and the second outlet, and the first and second outlets being structured to alternatively have an electrical connector of the number of electrical connectors be placed in electrical connection with one of the first outlet and the second outlet.

BRIEF DESCRIPTION OF THE DRAWINGS

A further understanding of the disclosed and claimed concept can be gained from the following Description when read in conjunction with the accompanying drawings in which:

Similar numerals refer to similar parts throughout the specification.

DESCRIPTION

Figure 1:
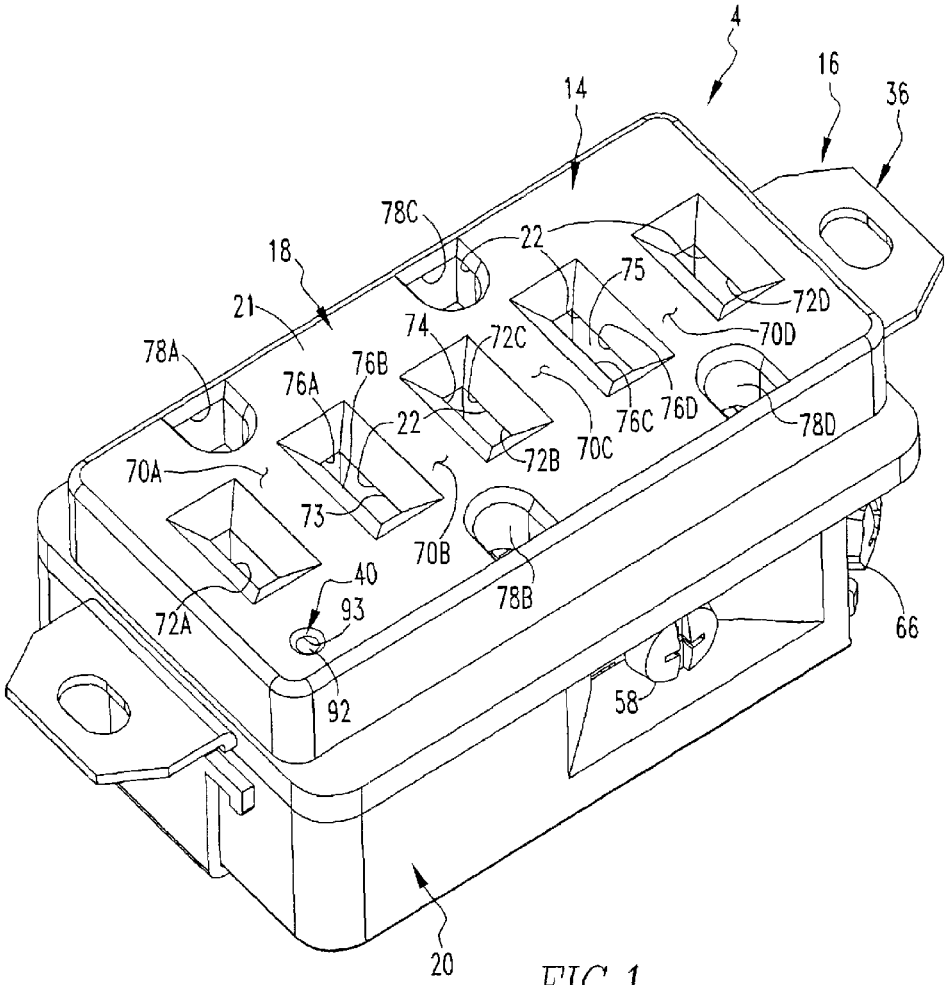
FIG. 1 is a perspective view of an improved electrical receptacle in accordance with a first embodiment of the disclosed and claimed concept.

An improved electrical receptacle 4 in accordance with a first embodiment of the disclosed and claimed concept is depicted generally in FIGS. 1-8. As can be understood from FIG. 2, the electrical receptacle 4 is configured to be electrically connected with a line conductor 6, a neutral conductor 8, and a ground conductor 10 such as are provided with conventional electrical service in buildings and the like. As will be set forth in greater detail below, the electrical receptacle 4 is structured to have one or two electrical connectors 12A and 12B, which may collectively or individually referred to herein with the numeral 12, placed in electrical connection therewith, such as is depicted in FIGS. 5-8. The electrical connectors 12 are, in a well understood fashion, each a part of an electrically-operated device that is connected by an electrical cable with the electrical connector, and the placing of the electrical connector 12 in electrical connection with the electrical receptacle 4 provides electrical power to the electrically-operated device.

Figure 2:
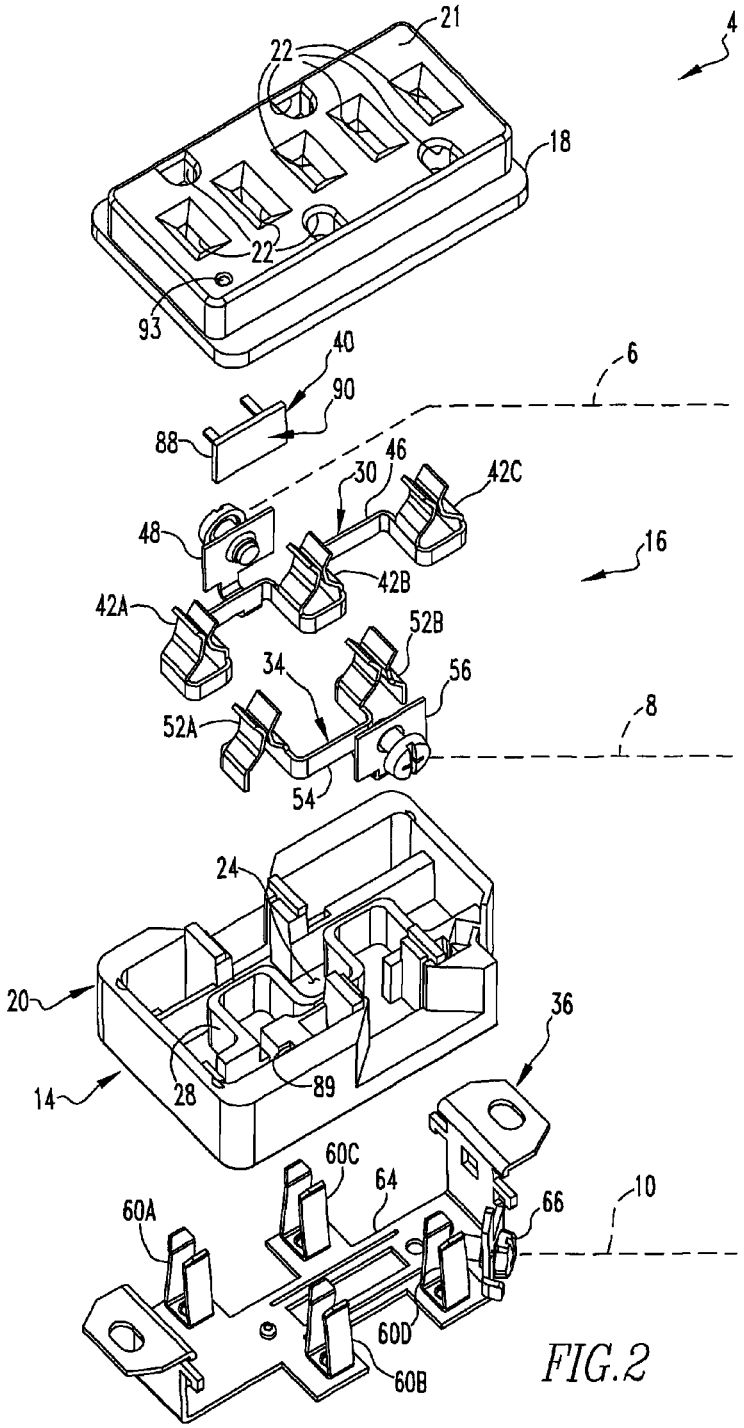
FIG. 2 is an exploded view of the electrical receptacle of FIG. 1.

The electrical receptacle 4 can be said to include a housing 14 and an electrical apparatus 16. As is best shown in FIG. 2, the housing 14 includes a front housing portion 18 and rear housing portion 20 that are connectable together through the use of ultrasonic welding or through other fastening techniques. The front housing portion 18 has a frontal surface 21 having formed therein a plurality of openings that are indicated generally at the numeral 22 and which also form a plurality of contact openings that are in communication with portions of the electrical apparatus 16 in a fashion that will be set forth in greater detail below. The rear housing portion 20 has a cavity 24 formed therein and further includes a serpentine-shaped insulative wall 28 that is situated in the cavity 24. The housing 14 can be formed from any of a wide variety of insulative materials such as plastic materials or other such insulative materials, many of which are well known in the relevant art.

As can further be seen in FIG. 2, the electrical apparatus 16 can be said to include a line conduction element 30, a neutral conduction element 34, a ground conduction element 36, and a protection apparatus 40. As can be understood from FIGS. 2 and 4, the line conduction element 30 and the neutral conduction element 34 are largely received within the cavity 24 and are situated on alternate sides of the insulative wall 28. As can be understood from FIGS. 1 and 2, the ground conduction element 36 is largely situated at the exterior of the housing 14, although portions of the ground conduction element 36 protrude into the cavity 24.

As can further be seen in FIG. 2, the line conduction element 30 can be said to include a set of line contacts that are indicated at the numeral 42A, another set of line contacts that are indicated at the numeral 42B, and a further set of line contacts that are indicated at the numeral 42C, and which may be collectively or individually referred to herein with the numeral 42. The line conduction element 30 further includes a line bus 46 with which the line contact sets 42 are electrically connected. The line conduction element 30 further includes a line terminal 48 that is electrically connected with the line bus 46 and which is electrically connectable with the line conductor 6.

The neutral conduction element 34 includes two sets of neutral contacts that are indicated at the numerals 52A and 52B, and which can be collectively or individually referred to herein with the numeral 52. The neutral conduction element 34 further includes a neutral bus 54 with which the neutral contact sets 52 are electrically connected. The neutral conduction element 34 additionally includes a neutral terminal 56 that is electrically connected with the neutral bus and that is electrically connectable with the neutral conductor 8.

The ground conduction element 36 can be said to include four sets of ground contacts that are indicated at the numerals 60A, 60B, 60C, and 60D, and which can be collectively or individually referred to herein with the numeral 60. The ground conduction element 36 further includes a ground bus 64 to which the ground contact sets 60 are electrically connected. The ground conduction element 36 further includes a ground terminal 66 electrically connected with the ground bus 64 and that is electrically connectable with the ground conductor 10.

Figure 3:
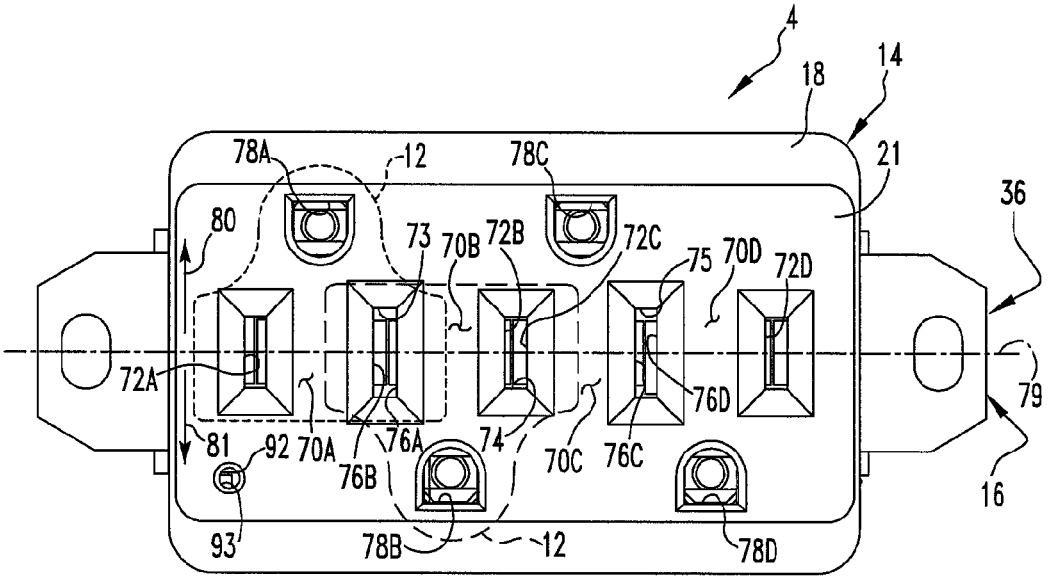
FIG. 3 is a top plan view of the electrical receptacle of FIG. 1.

As can be understood from FIGS. 1 and 3, the plurality of openings 22 can be said to form a plurality of electrical outlets that are indicated at the numerals 70A, 70B, 70C, and 70D, and which can be collectively or individually referred to herein with the numeral 70. Any one of the outlets 70 is capable of having one of the electrical connectors 12 placed in electrical communication therewith. It is noted, however, that, for reasons that will be set forth in greater detail below, the outlet 70 is capable of having one of the electrical connectors 12 placed in electrical communication therewith so long as none of the outlets directly adjacent thereto already have one of the electrical connectors 12 electrically connected therewith.

As can further be seen in FIGS. 1 and 3, the outlet 70A can be said to include a line contact opening 72A, a neutral contact opening 76A, and a ground contact opening 78A. Likewise, the outlet 70B can be said to include a line contact opening 72B, a neutral contact opening 76B, and a ground contact opening 78B. It is noted, however, that the neutral contact openings 76A and 76B are actually the same single opening, meaning that they are an individual neutral contact opening 73 that is common between the outlet 70A and the outlet 70B.

In a similar fashion, the outlet 70C has a line contact opening 72C, a neutral contact opening 76C, and a ground contact opening 78C. Similarly, however, the line contact opening 72B and the line contact opening 72C are the same single opening, meaning that they are an individual line contact opening 74 that is shared between the outlets 70B and 70C.

In a like fashion, the outlet 70D has a line contact opening 72D, a neutral contact opening 76D, and a neutral contact opening 78D. However, the neutral contact openings 76C and 76D are the same single contact opening, which is an individual neutral contact opening 75 that is common between the outlets 70C and 70D.

The line contact openings 72A, 72B, 72C, and 72D may be collectively or individually referred to herein with the numeral 72. The neutral contact openings 76A, 76B, 76C, and 76D may be collectively or individually referred to herein with the numeral 76. The ground contact openings 78A, 78B, 78C, and 78D may be collectively or individually referred to herein with the numeral 78.

Figure 4:
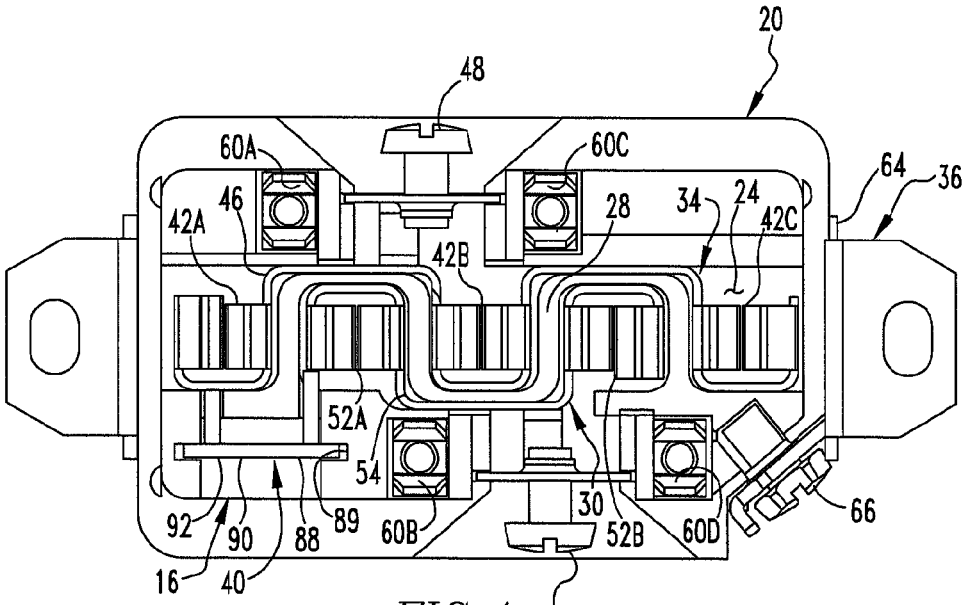
FIG. 4 is a view similar to FIG. 3, except depicting the electrical receptacle with a front housing portion removed.

As can be understood from FIGS. 2-4, the line contact opening 72A is formed from one of the openings 22 and is in communication with the line contact set 42A. The line contact openings 72B and 72C employ another opening 22 that is in communication with the line contact set 42B. The line contact opening 72D includes another opening 22 that is in communication with the line contact set 42C.

The neutral contact openings 76A and 76B employ another opening 22 that is in communication with the neutral contact set 52A. Likewise, the neutral contact openings 76C and 76D employ another opening 22 that is in communication with the neutral contact set 52B.

The ground contact openings 78A, 78B, 78C, and 78D employ four other openings 22 that are in communication with the ground contact sets 60A, 60B, 60C, and 60D, respectively.

As is best shown in FIG. 3, the line contact openings 72 and the neutral contact openings 76 are disposed along an axis 79 that extends generally centrally through the housing 14. The ground contact openings 78A and 78C are spaced in a first direction from the axis 79, with the first direction being represented by a first arrow 80. Likewise, the ground contact openings 78B and 78D are spaced in a second direction from the axis 79 opposite the first direction, with the second direction being represented by a second arrow 81. The individual line contact opening 74 is situated between the individual neutral contact opening 73 and the individual neutral contact opening 75. The insulative wall 28 electrically isolates the line conduction element 30 and the neutral conduction element 34 from one another.

Figure 5:
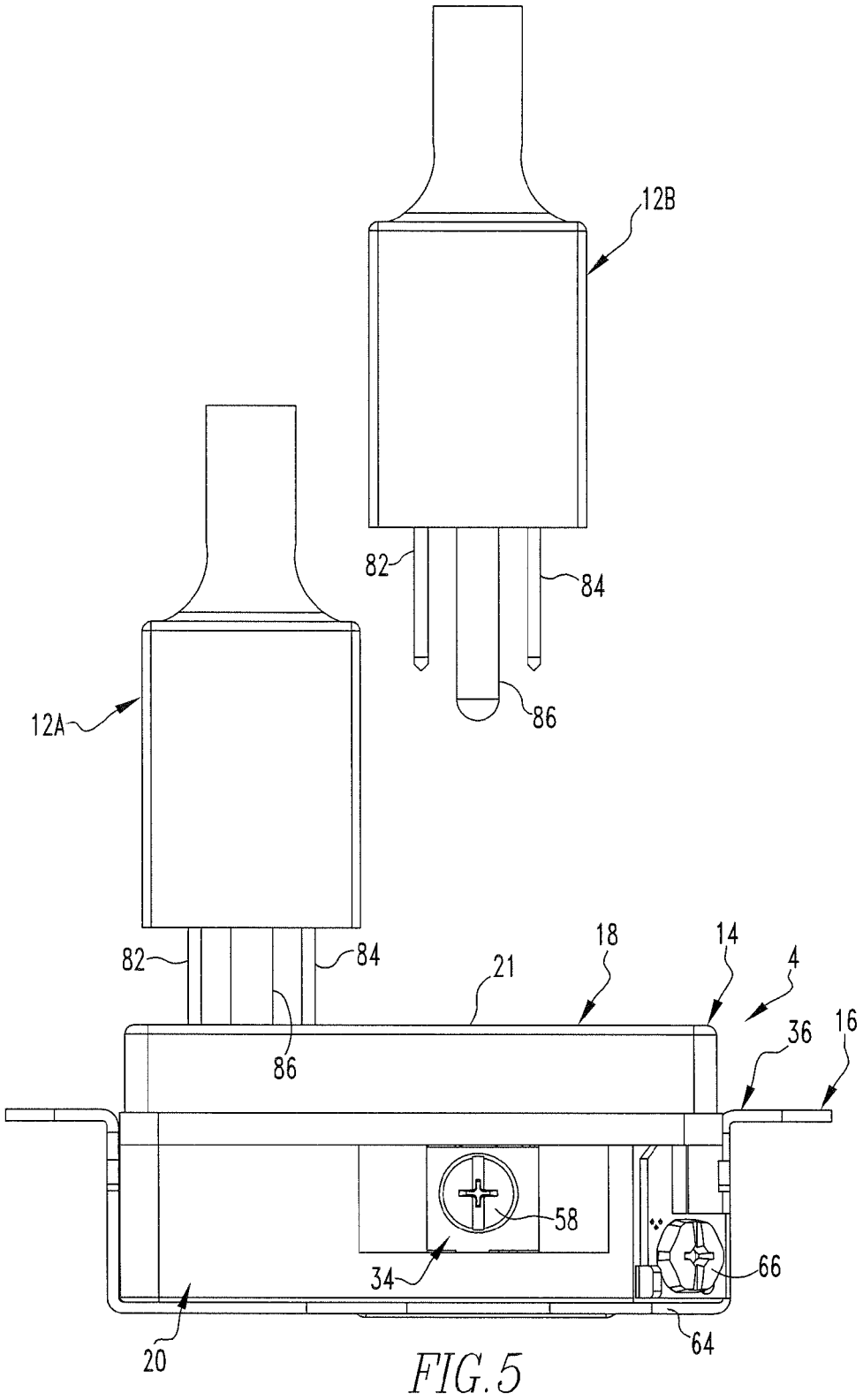
FIG. 5 is a side view of the electrical receptacle of FIG. 1 having a pair of electrical connectors being placed in electrical connection therewith, one of which is partially received in the electrical receptacle.

As can be understood from FIG. 5, the electrical connectors 12 each include a line prong 82, a neutral prong 84, and a ground prong 86. The line prong 82 is receivable in one of the line contact openings 72, the neutral contract prong 84 is receivable in one of the neutral contact opening 76, and the ground prong 86 is receivable in one of the ground contact openings 78.

Figure 6:
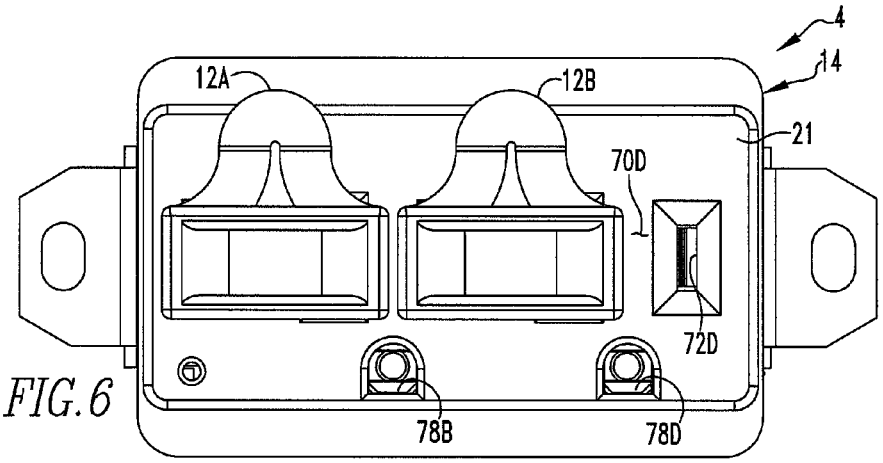
FIG. 6 is a top plan view of the electrical connectors and the electrical receptacle of FIG. 5.

FIGS. 5 and 6 depict the electrical connectors 12A and 12B being placed into electrical contact with the outlets 70A and 70C, respectively. In such a situation, all of the neutral contact openings 76, which actually are the individual neutral contact openings 73 and 75, are occupied by the electrical connectors 12, and it thus can be seen that in the configuration depicted in FIG. 6, no additional electrical connectors 12 are connectable with the outlets 70B and 70D when the outlets 70A and 70C already have electrical connectors 12 electrically connected therewith.

Figure 7:
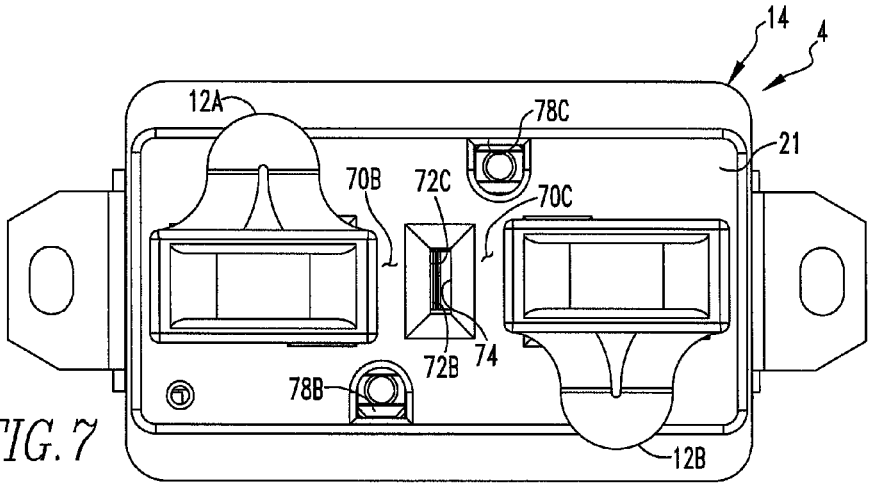
FIG. 7 is a view similar to FIG. 6, except depicting an alternative arrangement of the electrical connectors on the electrical receptacle.

It is noted, however, that the electrical connector 12B could be disconnected from the outlet 70C and instead electrically connected with the outlet 70D. This is the configuration depicted generally in FIG. 7. In FIG. 7, the outlets 70A and 70D have the electrical connectors 12A and 12B, respectively, electrically connected therewith, and it can be seen that neither of the adjacent outlets 70B and 70C is capable of receiving another electrical connector 12 to be placed in electrical connection therewith.

Figure 8:
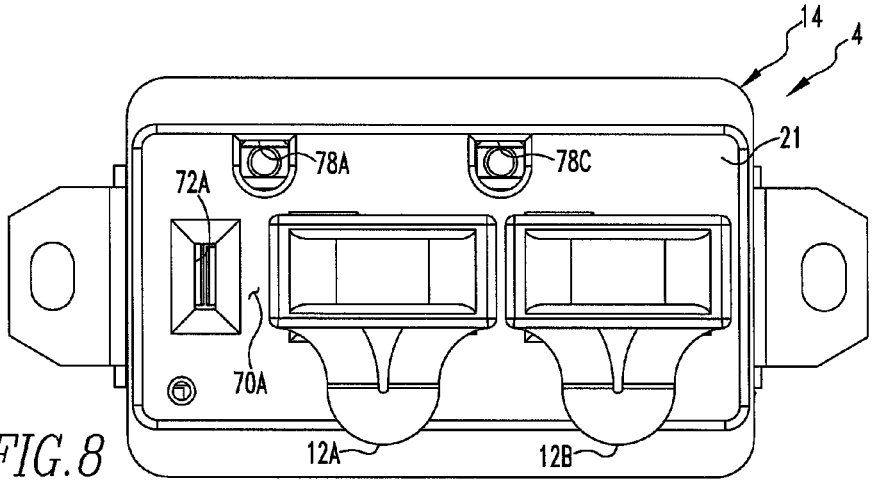
FIG. 8 is a view similar to FIG. 6, except depicting a further alternative arrangement of the electrical connectors on the electrical receptacle.

A further alternative is depicted in FIG. 8 wherein the electrical connector 12A is additionally removed from the outlet 70A and is instead placed into electrical connection with the outlet 70B. In such a situation, the outlets 70B and 70D have the electrical connectors 12A and 12B, respectively, connected therewith and the remaining outlets 70A and 70C are in such a situation incapable of receiving another electrical connector 12 to be placed in electrical communication therewith. It can be understood that any individual electrical connector 12 can be received in any individual outlet 70 so long as any outlets 70 situated adjacent thereto do not already have another electrical connector 12 electrically connected therewith.

It thus can be seen that the electrical receptacle 4 advantageously can have one or two electrical connectors 12 connected therewith at any given time. Such electrical connectors 12 can be situated in any of a plurality of orientations relative to the housing 14 due to the outlets 70 being situated in different orientations thereon, thereby enabling the electrical cable that is connected with the electrical connector 12 to extend in any of a variety of directions, and thereby relieving wire strain. Such versatility is accomplished by providing the individual neutral contact openings 73 and 75 and the individual line contact opening 74, which are each common among a pair of the outlets 70, and which thereby enable four outlets 70 to be provided in only a limited amount of space. This is enabled because, for example, the individual neutral contact opening 73 will receive therein the neutral prong 84 of the electrical connector 12 regardless of whether the electrical connector 12 is received in the outlet 70A (depicted in short dashed lines in FIG. 3) or whether the electrical connector 12 is electrically connected with the outlet 70B (depicted in long dashed lines in FIG. 3). The same type of advantage is provided by the individual line contact opening 74 and the individual neutral contact opening 75.

Further advantageously, the protection apparatus 40 includes a printed circuit board 88 that is receivable in a slot 89 formed in the rear housing portion 20 and which includes thereon a thermally protected metal oxide varistor (TMOV) 90. In the depicted exemplary embodiment, the exemplary protection apparatus 40 further includes a light emitting diode (LED) 92 that is also mounted on the printed circuit board 88 and which is observable through a hole 93 formed in the front housing portion 18.

Figure 9:
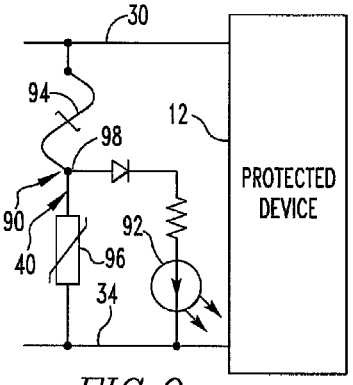
FIG. 9 is a schematic depiction of a protection apparatus of the electrical receptacle of FIG. 1.

As can be understood from FIG. 9, the TMOV 90 includes a thermal fuse 94 that is electrically connected in series with a metal oxide varistor (MOV) 96. The thermal fuse 94 is electrically connected with the line conduction element 30, and the MOV 96 is electrically connected with the neutral conduction element 34, with the thermal fuse 94 and the MOV 96 being electrically connected with one another at a connection point 98. The LED 92 is electrically connected between the connection point 98 and the neutral induction element 34.

In the exemplary depicted embodiment, the MOV 96 is a radial leaded MOV, and the thermal fuse 94 is an integrated thermally active element. The integrated configuration offers lower inductance than most discrete solutions, which results in improved clamping performance in response to fast over-voltage transients.

During normal operation of the electrical receptacle 4, the thermal fuse 94 is intact, and the LED 92 will be continuously illuminated. In the event of a surge or a transient that occurs in what can be considered to be normal conditions, the MOV 96 suppresses the voltage by clamping to a suitable control voltage, and the thermal fuse 94 remains intact, whereupon the LED 92 will continue to be continuously illuminated. However, in the event of a surge or transient in an abnormal overvoltage and limited current condition, the thermal fuse 94 will be overheated and will create an open circuit between the line conduction element 30 and the connection point 98, whereupon the LED 92 will cease to be illuminated. As such, if, during operation, the LED 92 is observed to be non-illuminated, this will indicate that the surge protection afforded by the protection apparatus 40 is disabled due to an abnormal overvoltage with limited current and is in need of replacement.

Figure 10:
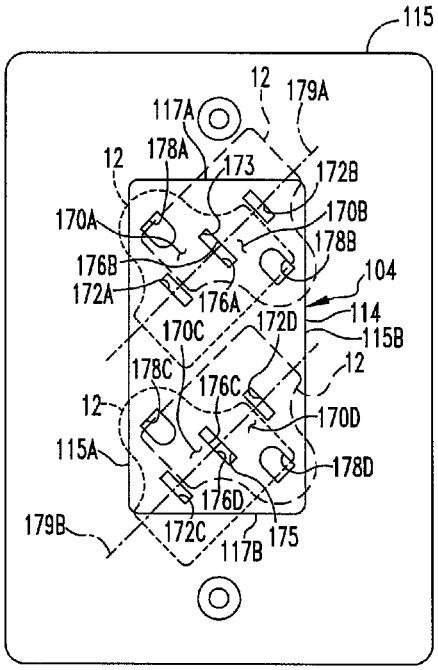
FIG. 10 is a front elevational view of an electrical receptacle in accordance with a second embodiment of the disclosed and claimed concept.

An improved electrical receptacle 104 in accordance with a second embodiment of the disclosed and claimed concept is depicted generally in FIG. 10. The electrical receptacle 104 is similar to the electrical receptacle 4 in certain respects. The electrical receptacle 104 includes a housing 114 and is depicted as having a faceplate 115 installed on the housing 114. The housing 114 is of a rectangular configuration and can be said to include a pair of sides 115A and 115B which may be collectively or individually referred to herein with the numeral 115 and which are situated adjacent the faceplate 115. The housing 114 also includes a pair of ends 117A and 117B which may be collectively or individually referred to herein with the numeral 117 and which are situated adjacent the faceplate 115.

In a fashion similar to the electrical receptacle 4, the electrical receptacle 104 includes a plurality of outlets 170A, 170B, 170C, and 170D, which may be collectively or individually referred to herein with the numeral 170. It is noted, however, that the plurality of outlets 170 are arranged in two banks of two outlets 170, i.e., the outlets 170A and 170B form a first bank, and the outlets 170C and 170D form a second bank.

The plurality of outlets 170 include a plurality of line contact openings 172A, 172B, 172C, and 172D, which may be collectively or individually referred to herein with the numeral 172. The outlets 170 further include a plurality of neutral contact openings 176A, 176B, 176C, and 176D, which may be collectively or individually referred to herein with the numeral 176. Likewise, the plurality of outlets 170 further include a plurality of ground contact openings 178A, 178B, 178C, and 178C, which may be collectively or individually referred to herein with the numeral 178. As can be understood from FIG. 10, the outlet 170A includes the contact openings 172A, 176A, and 178A, and the outlet 170B includes the contact openings 172B, 176B, and 178B. Likewise, the outlet 170C includes the contact openings 172C, 176C, and 178C, and the outlet 170D includes the contact openings 172D, 176D, and 178D. As can further be understood from FIG. 10, the neutral contact openings 176A and 176B are actually an individual neutral contact opening 173 that is common between the outlets 170A and 170B. That is, the individual neutral contact opening 173 will receive therein the neutral prong 84 of the electrical connector 12 regardless of whether the electrical connector 12 is electrically connected with the outlet 170A (as is shown in short dashed lines in the upper part of FIG. 10) or is instead electrically connected with the outlet 170B (as is shown in long dashed lines in the upper part of FIG. 10). The same can be said of the neutral contact openings 176C and 176D which form another individual neutral contact opening 175 that is common between the outlets 170C and 170D. That is, the individual neutral contact opening 175 will have the neutral prong 84 received therein regardless of whether the electrical connector 12 is electrically connected with the outlet 170C (as is indicated in short dashed lines in the lower part of FIG. 10) or is alternatively electrically connected with the outlet 170D (as is indicated in long dashed lines in the lower part of FIG. 10).

As can further be seen in FIG. 10, the line contact openings 172A and 172B and the individual neutral contact opening 173 lie along an axis 179A that is oriented oblique to the sides 115 and the ends 117. As employed herein, the expression "oblique" and variations thereof shall refer to a relationship that is neither parallel nor perpendiculars. Likewise, the line contact openings 172C and 172D and the individual neutral contract opening 175 lie along another axis 179B which is likewise oriented oblique to the sides 115 and the ends 117. The exemplary axes 179A and 179B are parallel with one another.

The oblique orientation enables all of the contact openings 172, 176, and 178 to be spaced from the faceplate 115, which is desirable. Furthermore, such oblique orientation of the axes 179A and 179B permits electrical devices having electrical connectors 12 to be connected with the outlets 170 from a plurality of directions while reducing strain on the electrical wiring of the electrical devices.

It can be seen that one of the electrical connectors 12 can be alternatively received in either of outlets 170A and 170B, and it can be seen that another electrical connector 12 can be alternatively received in either of outlets 170C and 170D regardless of which of the outlets 170A and 170B has the one electrical connector 12 connected therewith. As such, an electrical connector 12 can be received in the outlet 170B simultaneously with another electrical connector 12 being received in the outlet 170C. Other variations will be apparent.

Figure 11:
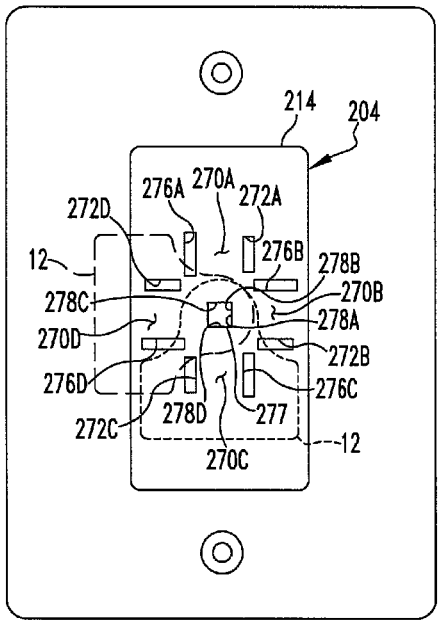
FIG. 11 is a front elevational view of an electrical receptacle in accordance with a third embodiment of the disclosed and claimed concept.

An improved electrical receptacle 204 in accordance with a third embodiment of the disclosed and claimed concept is depicted generally in FIG. 11. The electrical receptacle 204 is similar in some respects to the electrical receptacles 4 and 104 and includes a housing 214. The housing includes a plurality of outlets 270A, 270B, 270C, and 270D, which may be collectively or individually referred to herein with the numeral 270. The plurality of outlets 270 include a corresponding plurality of line contact openings 272A, 272B, 272C, and 272D, which may be collectively or individually referred to herein with the numeral 272. Likewise, the outlets 270 include a corresponding plurality of neutral contact openings 276A, 276B, 276C, and 276D, which may be collectively or individually referred to herein with the numeral 276. Furthermore, the plurality of outlets 270 include a corresponding plurality of ground contact openings 278A, 278B, 278C, and 278D, which may be collectively or individually referred to herein with the numeral 278.

The ground contact openings 278 form an individual ground contact opening 277 that is common to all four of the electrical outlets 270. That is, the individual ground contact opening 277 will receive the ground prong 86 therein of the electrical connector 12 that is electrically connected with any one of the four outlets 270. In this regard, it is understood that only a single electrical connector 12 is alternatively collectable with one of the outlets 270 from among the four outlets 270. However, the four outlets 270 enable an electrical device to be connected with the electrical receptacle 204 from any of a large number of directions while reducing strain on the wiring of such electrical device.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. An electrical receptacle structured to be electrically connected with a line conductor, a neutral conductor, and a ground conductor, the electrical receptacle further being structured to have a number of electrical connectors be placed in electrical connection therewith, the electrical receptacle comprising:

a housing;

an electrical apparatus that comprises a line conduction element, a neutral conduction element, and a ground conduction element;

the line conduction element being situated on the housing and structured to be electrically connected with the line conductor;

the neutral conduction element being situated on the housing and structured to be electrically connected with the neutral conductor;

the ground conduction element being situated on the housing and structured to be electrically connected with the ground conductor;

a plurality of outlets that comprise a first outlet and a second outlet;

the first outlet comprising a plurality of first openings formed in the housing, the plurality of first openings comprising a first line contact opening that is in communication with the line conduction element, a first neutral contact opening that is in communication with the neutral conduction element, and a first ground contact opening that is in communication with the ground conduction element;

the second outlet comprising a plurality of second openings formed in the housing, the plurality of second openings comprising a second line contact opening that is in communication with the line conduction element, a second neutral contact opening that is in communication with the neutral conduction element, and a second ground contact opening that is in communication with the ground conduction element;

one of:

the first line contact opening and the second line contact opening being an individual contact opening that is common between the first outlet and the second outlet, and the first ground contact opening and the second ground contact opening being an individual contact opening that is common between the first outlet and the second outlet; and the first and second outlets being structured to alternatively have an electrical connector of the number of electrical connectors be placed in electrical connection with one of the first outlet and the second outlet.

2. The electrical receptacle of claim 1 wherein the housing has a frontal surface, and wherein the plurality of first openings and the plurality of second openings are formed in the frontal surface.

3. The electrical receptacle of claim 1 wherein the individual contact opening is structured to receive a portion of the electrical connector therein regardless of whether the electrical connector is placed in electrical connection with the first outlet or is placed in electrical connection with the second outlet.

4. The electrical receptacle of claim 1 wherein the first and second line contact openings and the first and second neutral contact openings are situated along an axis, wherein the first ground contact opening is spaced away from the axis in a first direction, and wherein the second ground contact opening is spaced away from the axis in a second direction opposite the first direction.

5. The electrical receptacle of claim 1 wherein the first and second ground contact openings are the individual contact opening.

6. An electrical receptacle structured to be electrically connected with a line conductor, a neutral conductor, and a ground conductor, the electrical receptacle further being structured to have a number of electrical connectors be placed in electrical connection therewith, the electrical receptacle comprising:

a housing;

an electrical apparatus that comprises a line conduction element, a neutral conduction element, and a ground conduction element;

the line conduction element being situated on the housing and structured to be electrically connected with the line conductor;

the neutral conduction element being situated on the housing and structured to be electrically connected with the neutral conductor;

the ground conduction element being situated on the housing and structured to be electrically connected with the ground conductor;

a plurality of outlets that comprise a first outlet and a second outlet;

the first outlet comprising a plurality of first openings formed in the housing, the plurality of first openings comprising a first line contact opening that is in communication with the line conduction element, a first neutral contact opening that is in communication with the neutral conduction element, and a first ground contact opening that is in communication with the ground conduction element;

the second outlet comprising a plurality of second openings formed in the housing, the plurality of second openings comprising a second line contact opening that is in communication with the line conduction element, a second neutral contact opening that is in communication with the neutral conduction element, and a second ground contact opening that is in communication with the ground conduction element;

one of:

the first line contact opening and the second line contact opening being an individual contact opening that is common between the first outlet and the second outlet, the first neutral contact opening and the second neutral contact opening being an individual contact opening that is common between the first outlet and the second outlet, and the first ground contact opening and the second ground contact opening being an individual contact opening that is common between the first outlet and the second outlet; and the first and second outlets being structured to alternatively have an electrical connector of the number of electrical connectors be placed in electrical connection with one of the first outlet and the second outlet;

the plurality of outlets further comprise a third outlet;

the third outlet comprising a plurality of third openings formed in the housing;

the plurality of third openings comprising a third line contact opening that is in communication with the line conduction element, a third neutral contact opening that is in communication with the neutral conduction element, and a third ground contact opening that is in communication with the ground conduction element;

one of:

the second line contact opening and the third line contact opening being another individual contact opening that is common between the second outlet and the third outlet, the second neutral contact opening and the third neutral contact opening being another individual contact opening that is common between the second outlet and the third outlet, the second ground contact opening and the third ground contact opening being another individual contact opening that is common between the second outlet and the third outlet; and the first, second, and third outlets being structured to alternatively have the electrical connector be placed in electrical connection with one of the first outlet, the second outlet, and the third outlet.

7. The electrical receptacle of claim 6 wherein one of the first outlet and the third outlet is structured to have another electrical connector of the number of electrical connectors be placed in electrical connection therewith when the electrical connector is placed in electrical connection with the other of the first outlet and the third outlet.

8. The electrical receptacle of claim 6 wherein the individual contact opening and the another individual contact opening are a single contact opening that is common between the first outlet, the second outlet, and the third outlet.

9. The electrical receptacle of claim 6 wherein:

the plurality of outlets further comprise a fourth outlet;

the fourth outlet comprising a plurality of fourth openings formed in the housing;

the plurality of fourth openings comprising a fourth line contact opening that is in communication with the line conduction element, a fourth neutral contact opening that is in communication with the neutral conduction element, and a fourth ground contact opening that is in communication with the ground conduction element;

one of:

the third line contact opening and the fourth line contact opening being a further individual contact opening that is common between the third outlet and the fourth outlet, the third neutral contact opening and the fourth neutral contact opening being a further individual contact opening that is common between the third outlet and the fourth outlet, the third ground contact opening and the fourth ground contact opening being a further individual contact opening that is common between the third outlet and the fourth outlet; and the first, second, third, and fourth outlets being structured to alternatively have the electrical connector of the number of electrical connectors be placed in electrical connection with one of the first outlet, the second outlet, the third outlet, and the fourth outlet.

10. The electrical receptacle of claim 9 wherein the individual contact opening, the another individual contact opening, and the further individual contact opening are a single contact opening that is common between the first outlet, the second outlet, the third outlet, and the fourth outlet.

11. The electrical receptacle of claim 9 wherein the first outlet is structured to have another electrical connector of the number of electrical connectors be placed in electrical connection therewith when the electrical connector is placed in electrical connection with one of the third outlet and the fourth outlet.

12. The electrical receptacle of claim 9 wherein one of the first outlet and the second outlet is structured to have another electrical connector of the number of electrical connectors be placed in electrical connection therewith when the electrical connector is placed in electrical connection with the fourth outlet.

13. The electrical receptacle of claim 9 wherein the first and second neutral contact openings are the individual contact opening, and wherein the third and fourth neutral contact openings are the further individual contact opening.

14. The electrical receptacle of claim 9 wherein the first, second, third, and fourth line contact openings and the first, second, third, and fourth neutral contact openings are situated along an axis, wherein the first and third ground contact openings are spaced away from the axis in a direction, and wherein the second and fourth ground contact openings are spaced away from the axis in another direction opposite the direction.

15. The electrical receptacle of claim 14 wherein the first and second neutral contact openings are the individual contact opening, wherein the second and third line contact openings are the another individual contact opening, and wherein the third and fourth neutral contact openings are the further individual contact opening, the another individual contact opening being situated along the axis between the individual contact opening and the further individual contact opening.

16. The electrical receptacle of claim 1 wherein:

the plurality of outlets further comprise a third outlet and a fourth outlet;

the third outlet comprising a plurality of third openings formed in the housing, the plurality of third openings comprising a third line contact opening that is in communication with the line conduction element, a third neutral contact opening that is in communication with the neutral conduction element, and a third ground contact opening that is in communication with the ground conduction element;

the fourth outlet comprising a plurality of fourth openings formed in the housing, the plurality of fourth openings comprising a fourth line contact opening that is in communication with the line conduction element, a fourth neutral contact opening that is in communication with the neutral conduction element, and a fourth ground contact opening that is in communication with the ground conduction element;

one of:

the third line contact opening and the fourth line contact opening being an additional individual contact opening that is common between the third outlet and the fourth outlet, the third neutral contact opening and the fourth neutral contact opening being an additional individual contact opening that is common between the third outlet and the fourth outlet, the third ground contact opening and the fourth ground contact opening being an additional individual contact opening that is common between the third outlet and the fourth outlet; and the third and fourth outlets being structured to alternatively have another electrical connector of the number of electrical connectors be placed in electrical connection with one of the third outlet and the fourth outlet.

17. The electrical receptacle of claim 16 wherein the third and fourth outlets are structured to alternatively have the another electrical connector be placed in electrical connection therewith regardless of whichever of the first and second outlets has the electrical connector placed in electrical connection therewith.

18. An electrical receptacle structured to be electrically connected with a line conductor, a neutral conductor, and a ground conductor, the electrical receptacle further being structured to have a number of electrical connectors be placed in electrical connection therewith, the electrical receptacle comprising:

a housing;

an electrical apparatus that comprises a line conduction element, a neutral conduction element, and a ground conduction element;

the line conduction element being situated on the housing and structured to be electrically connected with the line conductor;

the neutral conduction element being situated on the housing and structured to be electrically connected with the neutral conductor;

the ground conduction element being situated on the housing and structured to be electrically connected with the ground conductor;

a plurality of outlets that comprise a first outlet and a second outlet;

the first outlet comprising a plurality of first openings formed in the housing the plurality of first openings comprising a first line contact opening that is in communication with the line conduction element, a first neutral contact opening that is in communication with the neutral conduction element, and a first ground contact opening that is in communication with the ground conduction element;

the second outlet comprising a plurality of second openings formed in the housing, the plurality of second openings comprising a second line contact opening that is in communication with the line conduction element, a second neutral contact opening that is in communication with the neutral conduction element, and a second ground contact opening that is in communication with the ground conduction element;

one of:

the first line contact opening and the second line contact opening being an individual contact opening that is common between the first outlet and the second outlet, the first neutral contact opening and the second neutral contact opening being an individual contact opening that is common between the first outlet and the second outlet, and the first ground contact opening and the second ground contact opening being an individual contact opening that is common between the first outlet and the second outlet; and the first and second outlets being structured to alternatively have an electrical connector of the number of electrical connectors be placed in electrical connection with one of the first outlet and the second outlet;

the plurality of outlets further comprise a third outlet and a fourth outlet;

the third outlet comprising a plurality of third openings formed in the housing, the plurality of third openings comprising a third line contact opening that is in communication with the line conduction element, a third neutral contact opening that is in communication with the neutral conduction element, and a third ground contact opening that is in communication with the pound conduction element;

the fourth outlet comprising a plurality of fourth openings formed in the housing, the plurality of fourth openings comprising a fourth line contact opening that is in communication with the line conduction element, a fourth neutral contact opening that is in communication with the neutral conduction element, and a fourth ground contact opening that is in communication with the ground conduction element;

one of:

the third line contact opening and the fourth line contact opening being an additional individual contact opening that is common between the third outlet and the fourth outlet, the third neutral contact opening and the fourth neutral contact opening being an additional individual contact opening that is common between the third outlet and the fourth outlet, the third ground contact opening and the fourth around contact opening being an additional individual contact opening that is common between the third outlet and the fourth outlet; and the third and fourth outlets being structured to alternatively have another electrical connector of the number of electrical connectors be placed in electrical connection with one of the third outlet and the fourth outlet;

wherein the housing is of a rectangular shape having a pair of sides that are parallel with one another and a pair of ends that are parallel with one another, wherein the first and second line contact openings and the first and second neutral contact openings are situated along an axis that is oriented oblique to the pair of sides and the pair of ends, and wherein the third and fourth line contact openings and the third and fourth neutral contact openings are situated along another axis that is oriented oblique to the pair of sides and the pair of ends.

19. The electrical receptacle of claim 1 wherein the electrical apparatus further comprises a protection apparatus having a Thermally protected Metal Oxide Varistor (TMOV) that is electrically connected between the line conduction element and the neutral conduction element, the TMOV comprising a thermal fuse element and a Metal Oxide Varistor (MOV) electrically connected together.

20. The electrical receptacle of claim 19 wherein the electrical apparatus further comprises an illumination source that is electrically connected between the neutral conduction element and an electrical connection that is situated electrically between the thermal fuse element and the MOV.

* * * * *